US011444395B1

(12) United States Patent
Wu

(10) Patent No.: US 11,444,395 B1
(45) Date of Patent: Sep. 13, 2022

(54) TERMINAL BLOCK WITH INTEGRAL GUIDING STRUCTURE

(71) Applicants: DINKLE ENTERPRISE CO., LTD., New Taipei (TW); DINKLE ELECTRIC MACHINERY (CHINA) CO., LTD., Jiangsu (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Jiangsu (CN)

( * ) Notice: Subject to any disclaimer, the term of this patent is extended or adjusted under 35 U.S.C. 154(b) by 57 days.

(21) Appl. No.: 17/220,904

(22) Filed: Apr. 1, 2021

(51) Int. Cl.
*H01R 9/24* (2006.01)
*H01R 13/24* (2006.01)
*H01R 13/502* (2006.01)

(52) U.S. Cl.
CPC ..... *H01R 9/2416* (2013.01); *H01R 13/24* (2013.01); *H01R 13/502* (2013.01)

(58) Field of Classification Search
CPC .... H01R 9/2416; H01R 13/24; H01R 13/502; H01R 4/48; H01R 4/4818; H01R 4/4827; H01R 4/4845
See application file for complete search history.

(56) References Cited

U.S. PATENT DOCUMENTS 7,686,626 B2 * 3/2010 Wu ..... H01R 4/64 439/95
7,686,627 B2 * 3/2010 Wu ..... H01R 9/2691 439/95
10,686,262 B2 * 6/2020 Wu ..... H01R 4/4818
2019/0013601 A1 1/2019 Pizzi

FOREIGN PATENT DOCUMENTS

| | | | |
|---|---|---|---|
| DE | 202010003385 | U1 | 6/2011 |
| DE | 102011055919 | A1 | 6/2013 |
| DE | 112019001295 | T5 | 12/2020 |
| DE | 112019001327 | T5 | 3/2021 |
| DE | 102021104504 | A1 | 9/2021 |
| EP | 3633795 | A1 | 4/2020 |

OTHER PUBLICATIONS

Office Action dated Sep. 13, 2021 of the corresponding German patent application No. 102021110757.1.

* cited by examiner

*Primary Examiner* — Vanessa Girardi
(74) *Attorney, Agent, or Firm* — Chun-Ming Shih; HDLS IPR Services

(57) ABSTRACT

This disclosure is a terminal block. An insulative base includes an accommodating space and an insertion hole. The insulative base includes a lateral opening. A guiding structure is disposed in the accommodating space and includes a guiding plate and a guiding arm. A passing space is formed between the insulative base and the guiding plate. An L-shaped space is formed between the guiding plate and the insulative base. A U-shaped space is formed between the guiding arm and the insulative base. A conducting terminal is positioned in the L-shaped space. An elastic strip includes an abutting section, a positioning section and a U-shaped section connected therebetween. The elastic strip is inserted to the passing space and the U-shaped space to be connected with the guiding arm.

10 Claims, 7 Drawing Sheets

TERMINAL BLOCK WITH INTEGRAL GUIDING STRUCTURE

BACKGROUND

Technical Field

The disclosure relates a terminal block, particularly to a terminal block with an elastic strip.

Description of Related Art

A terminal block is an electric connection device composed of an insulative base and a guiding structure for electrically connecting multiple wires or using as the data transmission line. A terminal block includes a conducting terminal and an elastic strip. The assembly method places the conducting terminal in the insertion base first, and then bends and positions the elastic strip in the conducting terminal. As a result, when a wire is inserted into the insertion base, the wire can be clamped between the elastic strip and the conducting terminal by the elasticity of the elastic strip.

However, in the manufacturing process of the related-art terminal blocks, the elastic strip of the guiding structure needs to be bent with a large angle to be placed in the insulative base. And the elastic strip is also bent with a large angle to be positioned on the conducting terminal. Thus, the elastic strip may have the issue of permanent deformation and lacking elastic clamping force.

In view of this, the inventors have devoted themselves to the above-mentioned related art, researched intensively and cooperated with the application of science to try to solve the above-mentioned problems. Finally, the disclosure which is reasonable and effective to overcome the above drawbacks is provided.

SUMMARY

An object of the disclosure is to provide a terminal block with an elastic strip facilitating assembly, which makes the elastic strip be assembled in the insulative base without being bent to excessive angle to keep the elastic clamping force.

To accomplish the above object, the disclosure provides a terminal block including an insulative base, a guiding structure, a conducting terminal and an elastic strip. The insulative base includes an accommodating space and an insertion hole communicating with the accommodating space. The insertion hole forms an inserting direction in the accommodating space. The insulative base includes a lateral opening disposed on a side surface. A normal line of the side surface is perpendicular to the inserting direction. The guiding structure is disposed in the accommodating space and includes a guiding plate and a guiding arm connected to the guiding plate. A passing space is formed between the insulative base and a top of the guiding plate facing the insertion hole. An L-shaped space is formed between two adjacent sides of the guiding plate and the insulative base. A U-shaped space is formed between two adjacent sides of the guiding arm and the insulative base. The conducting terminal is positioned in the L-shaped space. The elastic strip includes an abutting section, a positioning section and a U-shaped section connected between the abutting section and the positioning section. The elastic strip is inserted to the passing space and the U-shaped space through the lateral opening to be connected with the guiding arm.

In comparison with related art, the guiding structure of the terminal block of the disclosure includes a guiding plate and a guiding arm. A passing space is formed between the insulative base and a top of the guiding plate facing the insertion hole. An L-shaped space is formed between two adjacent sides of the guiding plate and the insulative base. A U-shaped space is formed between two adjacent sides of the guiding arm and the insulative base. As a result, when the elastic strip is being assembled to the U-shaped space, the abutting section may be inserted to the passing space first and then the U-shaped section is placed around the annular bar of the guiding structure and the positioning section is pressed to be disposed in the U-shaped space. Thus, the elastic strip may be assembled in the insulative base without being bent to excessive angle. Thus, the elastic clamping force may be kept and the practicality may be increased.

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
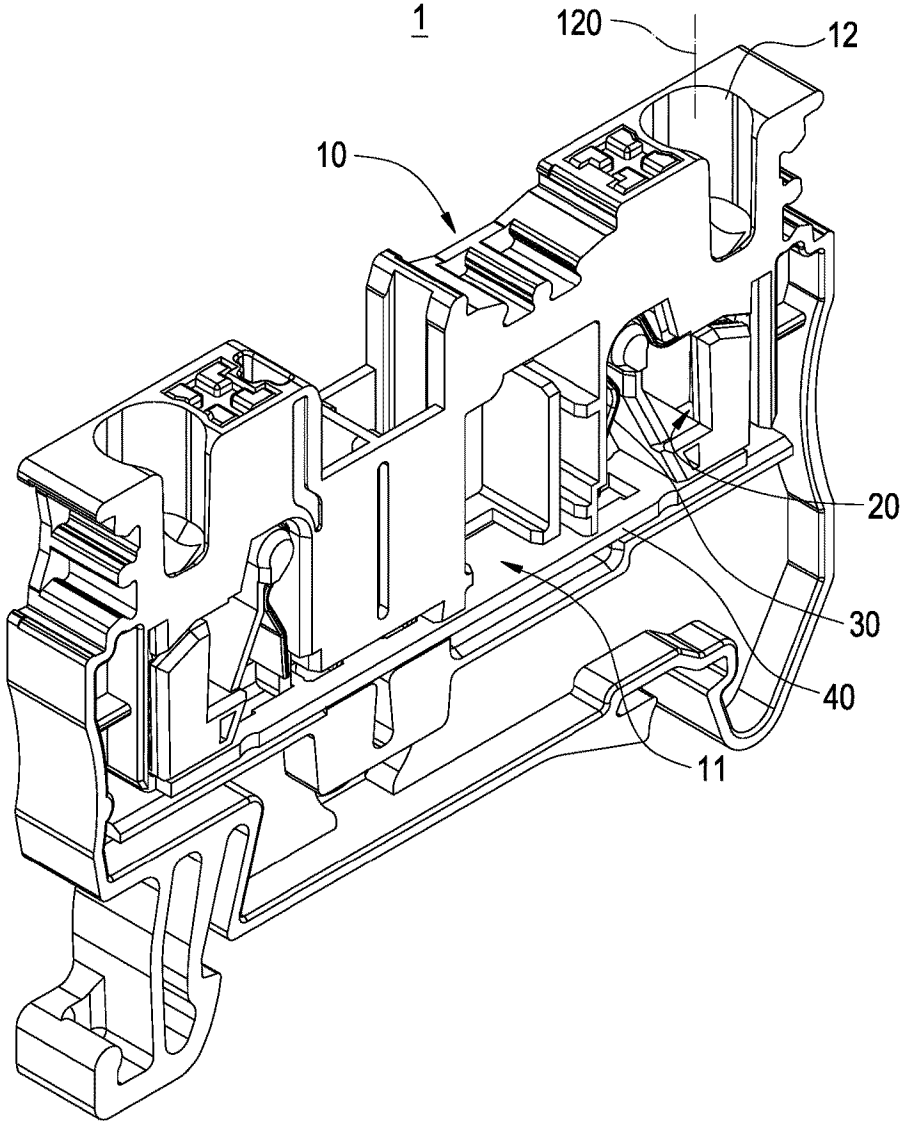
FIG. 1 is a perspective view of the terminal block of the disclosure.
Figure 2:
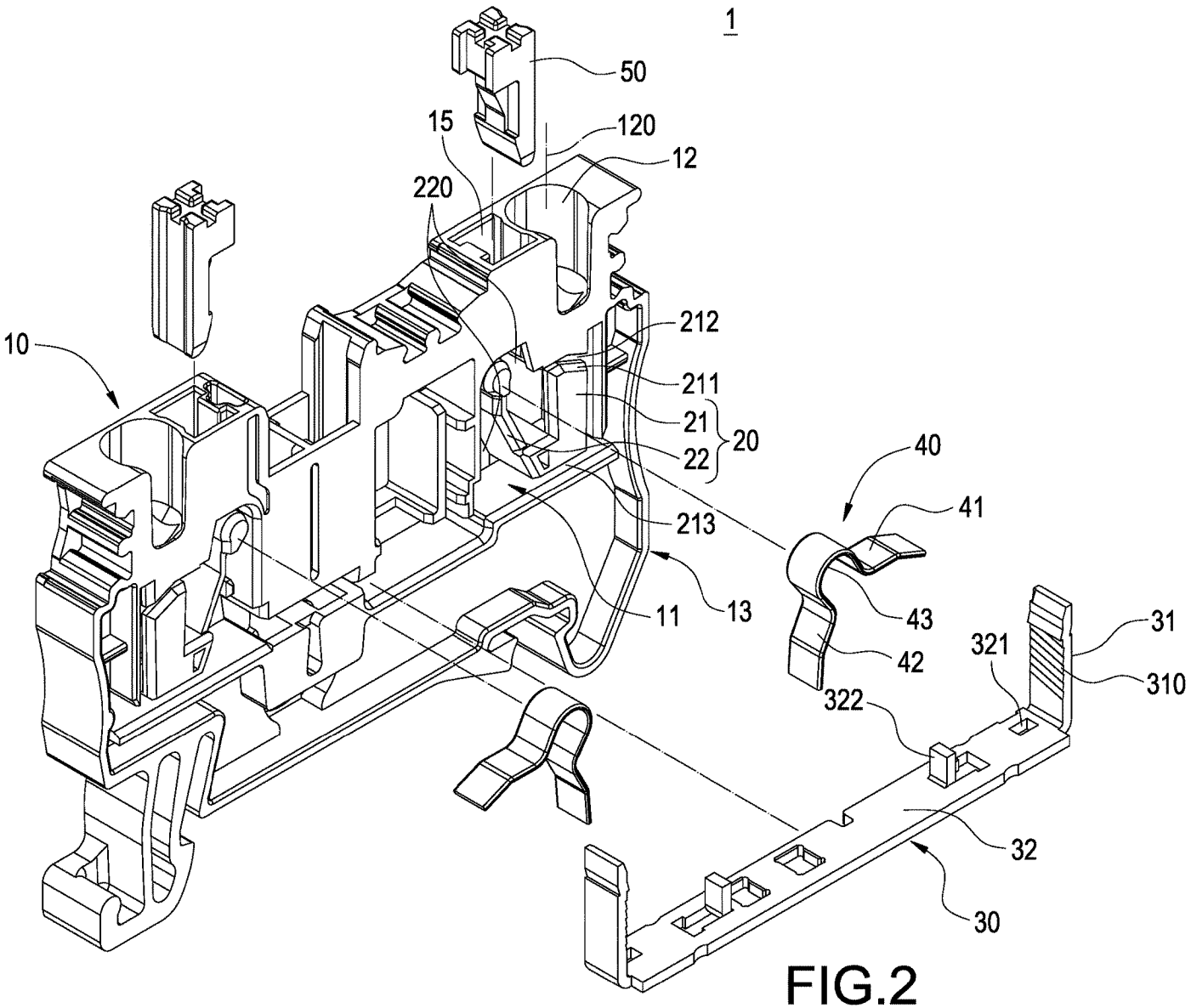
FIG. 2 is an exploded view of the terminal block of the disclosure.
Figure 3:
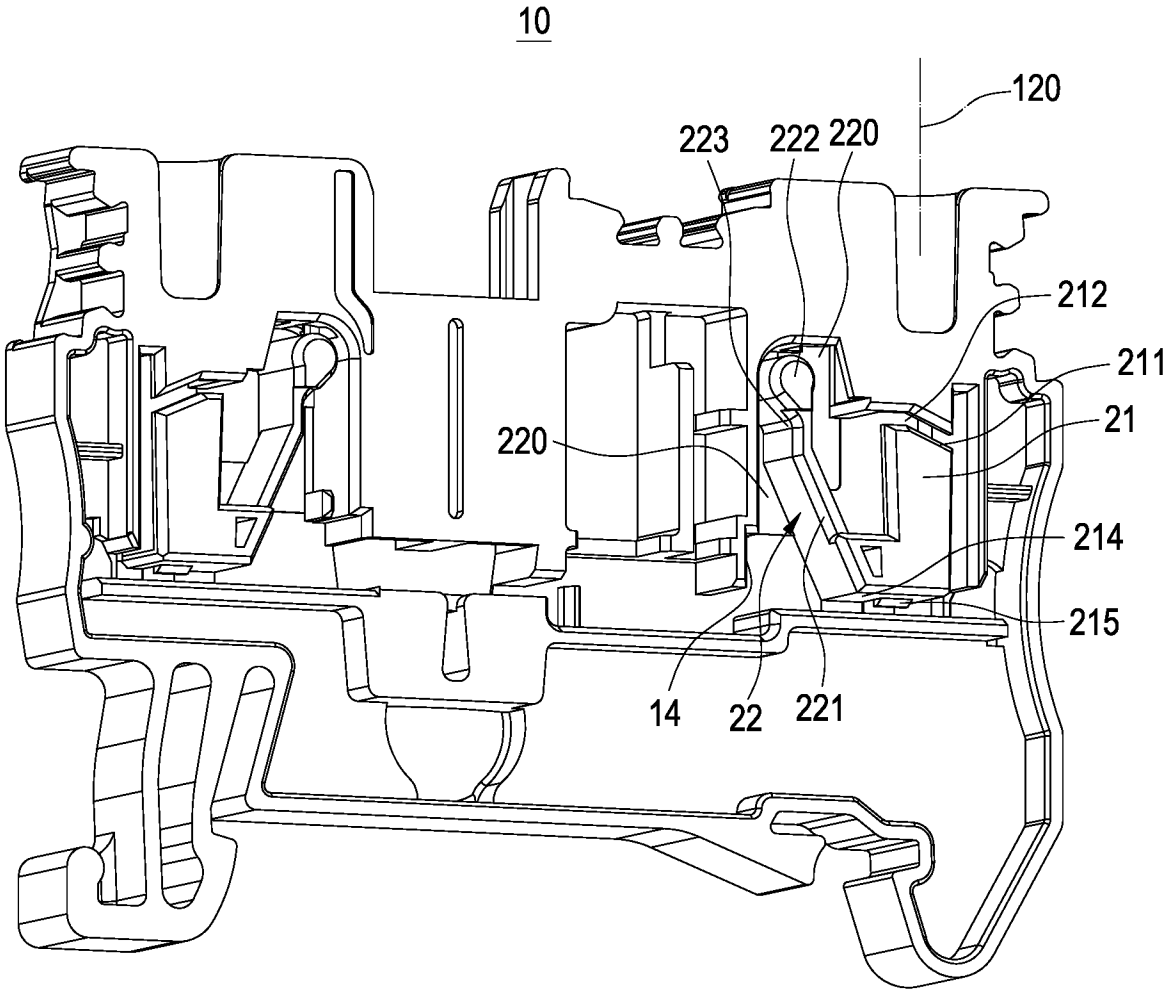
FIG. 3 is a perspective view of the insulative base of the disclosure.

Please refer to FIGS. 1-3, which are a perspective view, an exploded view and a perspective view of the insulative base of the terminal block of the disclosure. The disclosure provides a terminal block 1 including an insulative base 10, a guiding structure 20, a conducting terminal 30 and an elastic strip 40. The guiding structure 20 is disposed in the insulative base 10 and is formed with the insulative base 10 in one piece. The conducting terminal 30 and the elastic strip 40 are assembled in the insulative base 10 to form the terminal block 1. The details of the terminal block 1 are described below.

The insulative base 10 has an accommodating space 11 and an insertion hole 12 communicating with the accommodating space 11. The insertion hole 12 forms an inserting direction 120 in the accommodating space 11. In other words, an extending direction of the insertion hole 12 is aligned along an inserting direction 120 in the accommodating space 11. The insulative base 10 has a lateral opening 13 disposed on a side surface. A normal line of the side surface is perpendicular to the inserting direction 120.

The guiding structure 20 is disposed in the accommodating space 11 and includes a guiding plate 21 and a guiding arm 22 connected to the guiding plate 21. A passing space 212 is formed between the insulative base 10 and a top 211 of the guiding plate 21. The top 211 of the guiding plate 21 faces the insertion hole 12. An L-shaped space 213 is formed between two adjacent sides of the guiding plate 21 and the insulative base 10. A U-shaped space 220, which communicates with the passing space 212, is formed between two adjacent sides of the guiding arm 22 and the insulative base 10.

The conducting terminal 30 is made of conductive metal and positioned in the L-shaped space 213 formed between two adjacent sides of the guiding plate 21 and the insulative base 10.

The elastic strip 40 includes an abutting section 41, a positioning section 42 and a U-shaped section 43 connected between the abutting section 41 and the positioning section 42. The elastic strip 40 is inserted to the passing space 212 and the U-shaped space 220 through the lateral opening 13 to be connected with the guiding arm 22.

In detail, in the guiding structure 20, the guiding plate 21 is located adjacent to the insertion hole 12 and extends along the inserting direction 120 to cover part of the lateral opening 13. In some embodiments, the guiding plate 21 is an L-shaped plate, and the top 211 of the guiding plate 21 is a slant.

The guiding arm 22 aslant extends from the guiding plate 21 and includes an extending arm 221 connected with the guiding plate 21, an annular bar 222 and a neck portion 223 located between the extending arm 221 and the annular bar 222. In addition, the U-shaped section 43 of the elastic strip 40 is placed around the annular bar 222 and abuts against the neck portion 223.

In an embodiment, the conducting terminal 30 includes an engaging section 31 and an extending section 32 connecting with the engaging section 31. The engaging section 31 is formed with multiple engaging slots 310 for positioning the abutting section 41 of the elastic strip 40.

In this embodiment, the guiding plate 21 is extended with a bottom plate 214 toward the inside of the accommodating space 11. The bottom plate 214 has a positioning block 215 (please refer to FIG. 3). In addition, the extending section 32 of the conducting terminal 30 is formed with a positioning hole 321 and a tab 322. The insulative base 10 is formed with a positioning slot 14 for positioning the tab 322.

Furthermore, in this embodiment, the terminal block 1 includes an insertion rod 50. The insulative base 10 is formed with a tool hole 15 on a side of the insertion hole 12. The tool hole 15 communicates with the accommodating space 11. The insertion rod 50 is movably accommodated in the tool hole 15.

In an embodiment, the amount of the insertion hole 12 is multiple. The amount of the guiding structure 20, the amount of the elastic strip 40 and the amount of the conducting terminal 30 are multiple corresponding to the amount of the insertion hole 12. In some embodiments, the insertion hole 12, the guiding structure 20 and the elastic strip 40 are two in number respectively. The conducting terminal 30 is of a U shape and includes two engaging sections 31 and an extending section 32 connected between the two engaging sections 31. Thus, the terminal block 1 may be inserted by multiple wires 2.

Figure 4:
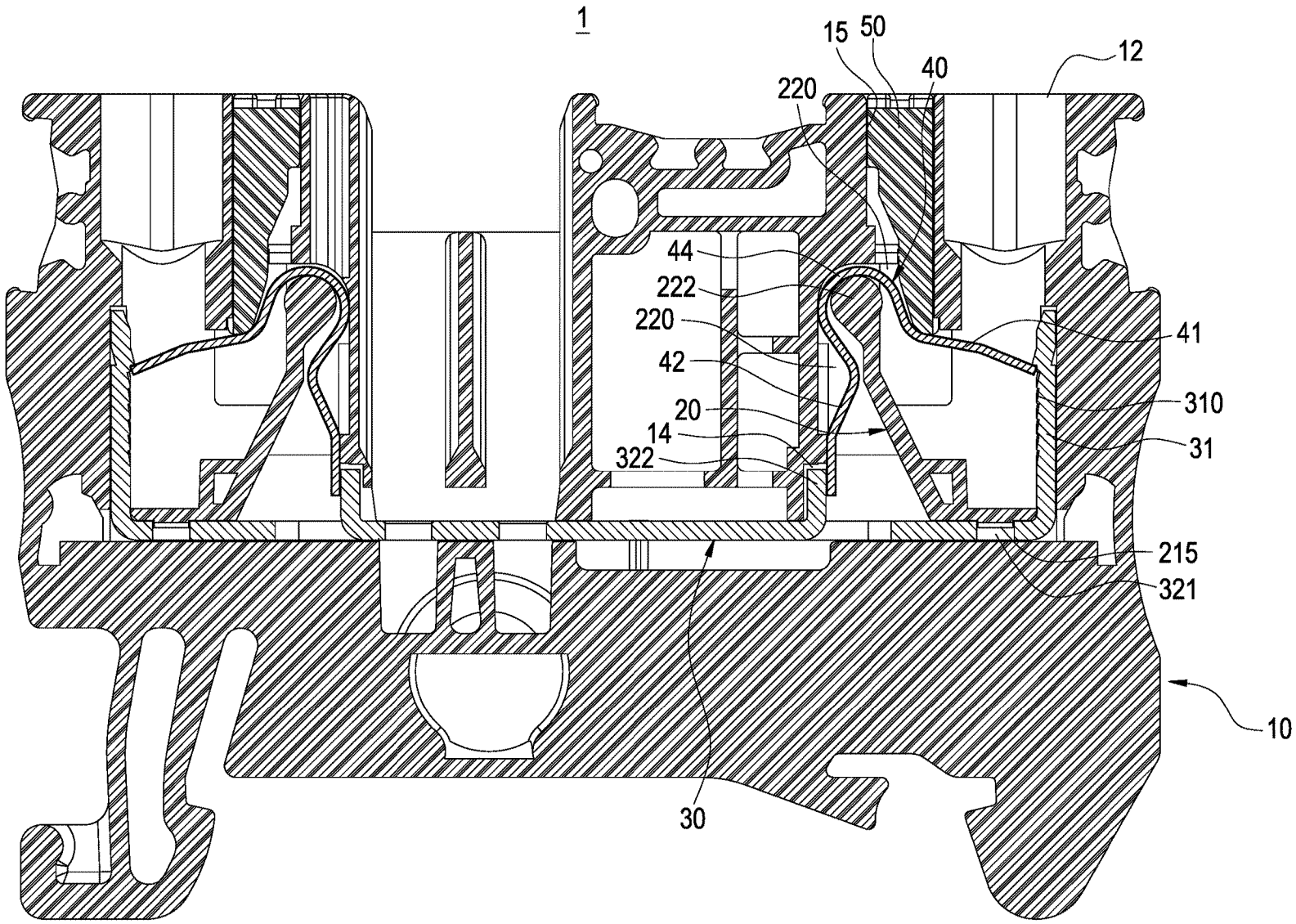
FIGS. 4 and 5 are cross-sectional views of the terminal block of the disclosure.
Figure 5:
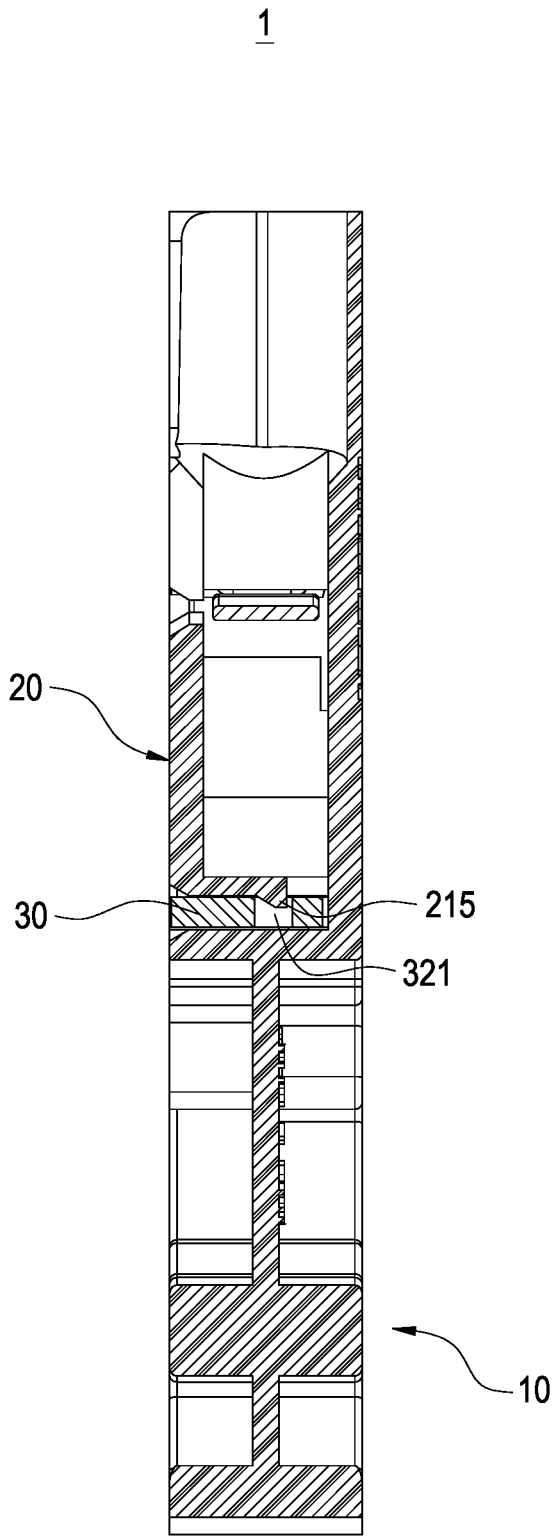

Please refer to FIGS. 4 and 5, which are cross-sectional views of the terminal block of the disclosure. When assembling the terminal block 1 of the disclosure, the conducting terminal 30 is inserted into the L-shaped space 213 of the insulative base 10 through the lateral opening 13 first. The positioning hole 321 of the conducting terminal 30 engages with the positioning block 215 of the insulative base 10 as shown in FIG. 5. Moreover, the tab 322 abuts against the positioning slot 14 of the insulative base 10 as shown in FIG. 4. As a result, the conducting terminal 30 is positioned in the L-shaped space 213.

In addition, when the elastic strip 40 is assembled to the U-shaped space 220 through the lateral opening 13, the abutting section 41 may be inserted to the passing space 121 first (referring to FIG. 3), and then the U-shaped section 43 is placed around the annular bar 222 of the guiding structure 20 and the positioning section 42 is pressed to be disposed in the U-shaped space 220. Thus, the elastic strip 40 may be positioned on the guiding arm 22 without being bent to excessive angle. It is noted that the abutting section 41 extends into the insertion hole 12 when the elastic strip 40 is not pressed.

Figure 6:
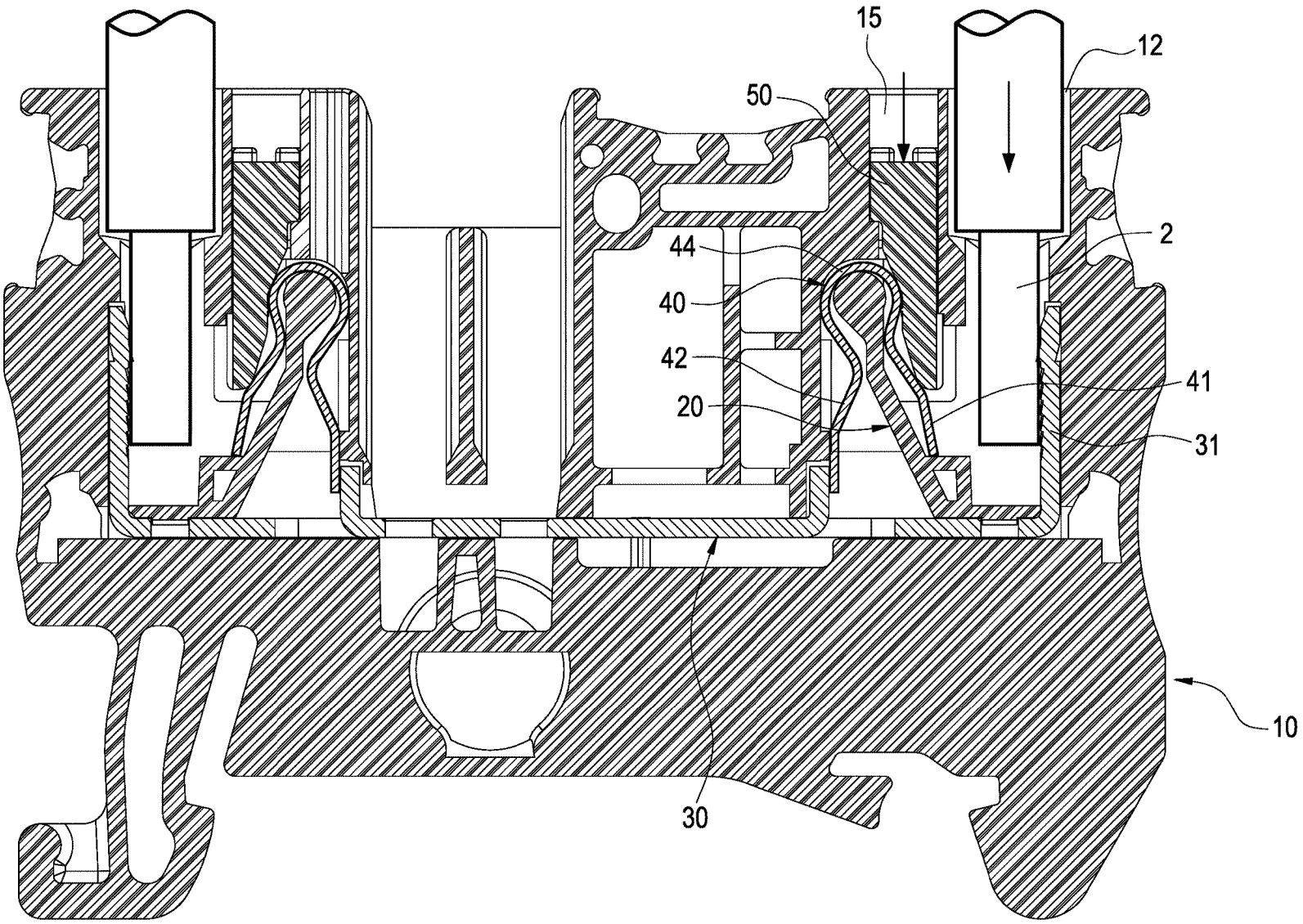
FIGS. 6 and 7 are schematic views of the terminal block of the disclosure in use.
Figure 7:
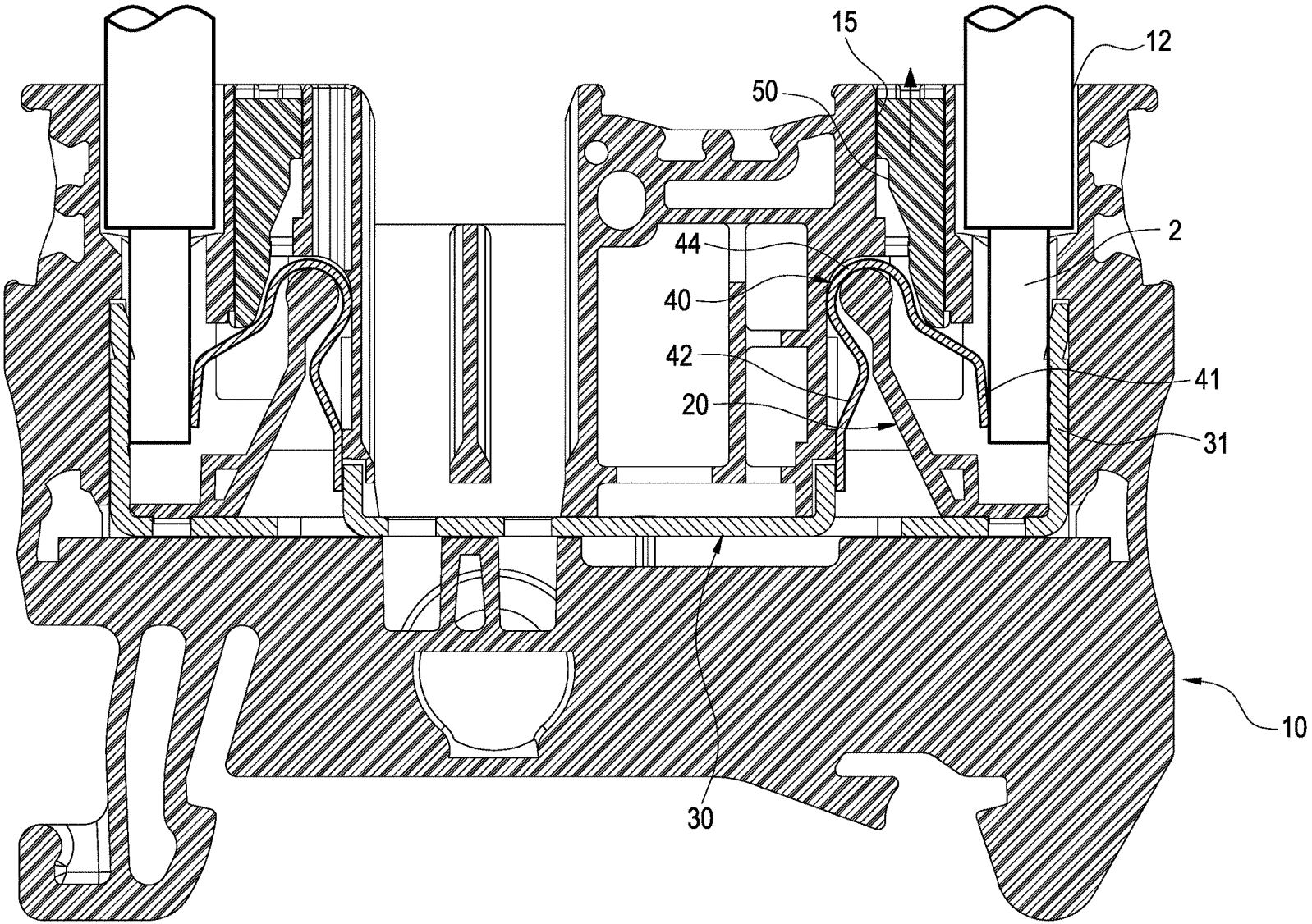

Please refer to FIGS. 6 and 7, which are schematic views of the terminal block of the disclosure in use. As shown in FIG. 6, the terminal block 1 is used for receiving insertion of at least one wire 2. In usage, the insertion rod 50 in the tool hole 15 is pushed to move downward first. The insertion rod 50 presses the elastic strip 40 and the abutting section 41 is pressed to leave the insertion hole 12 to facilitate the insertion of the wire 2 into the insertion hole 12 to electrically connect with the conducting terminal 30.

Please refer to FIG. 7. After the wire 2 is inserted to the positioning location, the force exerted thereon may be removed. The insertion rod 50 is pushed by the restoring force of the elastic strip 40 to move upward, and the abutting section 41 abuts against the wire 2 under the elastic force. As a result, the wire 2 is clamped between the conducting terminal 30 and the elastic strip 40 and electrically connected with the conducting terminal 30.

While this disclosure has been described by means of specific embodiments, numerous modifications and variations could be made thereto by those skilled in the art without departing from the scope and spirit of this disclosure set forth in the claims.

What is claimed is:

1. A terminal block inserted by at least one wire, the terminal block comprising:

an insulative base, comprising an accommodating space and an insertion hole communicating with the accommodating space, an extending direction of the insertion hole aligned along an inserting direction in the accommodating space, and the insulative base comprising a lateral opening disposed on a side surface, wherein a normal line of the side surface is perpendicular to the inserting direction;

a guiding structure, disposed in the accommodating space, comprising a guiding plate and a guiding arm connected to the guiding plate, wherein a passing space is disposed between the insulative base and a top of the guiding plate facing the insertion hole, an L-shaped space is disposed between two adjacent sides of the guiding plate and the insulative base, and a U-shaped space is disposed between two adjacent sides of the guiding arm and the insulative base;

a conducting terminal, positioned in the L-shaped space; and an elastic strip, comprising an abutting section, a positioning section and a U-shaped section connected between the abutting section and the positioning section, and the elastic strip inserted to the passing space and the U-shaped space through the lateral opening to be connected with the guiding arm.

2. The terminal block of claim 1, wherein the guiding structure and the insulative base are formed in one piece.

3. The terminal block of claim 1, wherein the guiding plate is located adjacent to the insertion hole and extends along the inserting direction to cover part of the lateral opening.

4. The terminal block of claim 1, further comprising an insertion rod, wherein the insulative base comprises a tool hole disposed on a side of the insertion hole, the tool hole communicates with the accommodating space, and the insertion rod is movably accommodated in the tool hole to press the abutting section and to position an end of the abutting section in one of the engaging slots.

5. The terminal block of claim 1, wherein the guiding plate comprises an L-shaped plate, the top of the guiding plate comprises a slant, and the guiding arm aslant extends from the guiding plate.

6. The terminal block of claim 5, wherein the guiding arm comprises an extending arm connected with the guiding plate, an annular bar and a neck portion disposed between the extending arm and the annular bar, and the U-shaped section of the elastic strip is placed around the annular bar and abuts against the neck portion.

7. The terminal block of claim 1, wherein the conducting terminal comprises an engaging section and an extending section connected with the engaging section, and the engaging section comprises multiple engaging slots positioning the abutting section of the elastic strip.

8. The terminal block of claim 7, wherein the guiding plate comprises a bottom plate extended toward an inside of the accommodating space, the bottom plate comprises a positioning block, the extending section of the conducting terminal comprises a positioning hole and a tab, and the insulative base comprises a positioning slot positioning the tab.

9. The terminal block of claim 1, wherein an amount of the insertion hole is multiple, an amount of the guiding structure, an amount of the elastic strip and an amount of the conducting terminal are multiple corresponding to the amount of the insertion hole.

10. The terminal block of claim 9, wherein the insertion hole, the guiding structure and the elastic strip are two in number respectively, the conducting terminal is of a U shape and comprises two engaging sections and an extending section connected between the two engaging sections.

* * * * *